US005101524A

United States Patent [19]

Brandschain

[11] Patent Number: 5,101,524

[45] Date of Patent: Apr. 7, 1992

[54] SOFA-PLATFORM BED

[76] Inventor: Daniel B. Brandschain, P.O. Box 1741, Avon, Colo. 81620

[21] Appl. No.: 712,745

[22] Filed: Jun. 10, 1991

[51] Int. Cl.[5] ..... A47C 17/13

[52] U.S. Cl. ..... 5/17; 5/18.1; 5/30

[58] Field of Search ..... 5/14, 17, 18.1, 23, 5/30, 35

[56] References Cited

U.S. PATENT DOCUMENTS

| | | | |
|---|---|---|---|
| 1,602,701 | 10/1926 | Petersen | 5/35 |
| 2,997,724 | 8/1961 | Heumann | 5/18.1 |
| 3,041,635 | 7/1962 | Holztclaw | 5/18.1 |
| 3,079,614 | 3/1963 | Jackson | 5/17 |
| 4,366,585 | 1/1983 | Ponti et al. | 5/18.1 |
| 4,481,684 | 11/1984 | Hanck | 5/18.1 |
| 4,803,742 | 2/1989 | Rasnick et al. | 5/18.1 |

FOREIGN PATENT DOCUMENTS

| | | | |
|---|---|---|---|
| 595273 | 12/1947 | United Kingdom | 5/18.1 |

*Primary Examiner*—Michael F. Trettel

*Attorney, Agent, or Firm*—Charles C. Logan, II

[57] ABSTRACT

A sofa that is convertible into a platform bed has a transversely extending stationary frame. A left arm assembly, a right arm assembly and a back assembly are attached to the stationary frame. The sofa seat and back cushions are removable from a support surface located above the stationary frame. A plurality of laterally spaced telescoping slide assemblies have their rear ends secured to the stationary frame. The telescoping slide assemblies each have an elongated rear telescoping member, at least one elongated intermediate telescoping member and an elongated front telescoping member and all of the telescoping members have a top wall surface that remains in substantially the same horizontal plane when they are in their retracted position and when they are in their extended position. The cushion support platform assembly may take one of several forms but they all stow in a position above the stationary frame and below the seat cushion. The cushion support platform in its extended position has a bottom planar surface that rests on the planar top surface of the telescoping slide assemblies in their extended state.

10 Claims, 6 Drawing Sheets

SOFA-PLATFORM BED

BACKGROUND OF THE INVENTION

The present invention relates generally to beds, and more particularly to a sofa convertible to a bed.

The prior art contains a considerable number of designs for sofas that are convertible to beds. The vast majority of these sofa beds can be folded, where a plurality of sections are hinge connected so the sofa can be converted to a bed by a complex series of horizontal and vertical motions, or extensibly where the sections are withdrawn linearly to provide a planar sleeping surface.

The folding sofa beds, although having enjoyed the greatest commercial success, require rather complicated operating mechanisms which greatly contribute to the weight of the unit and its manufacturing costs. In addition, since sofa beds of this type generally require a lifting motion, it cannot be used by persons unable to perform heavy lifting. Finally, the mattress overlying the sleeping or sitting surface of foldable sofa beds must undergo considerable bending which greatly reduces the life of the mattress, dictates against use of a good quality matress and can further result in damage to the mattress resiliency which makes sleeping or sitting an uncomfortable experience, particularly those persons with back problems.

Extensible sofa beds have also suffered similar draw backs. For example, complex guide mechanisms must be employed to insure that the extensible sections do not jam when the unit is opened or closed. This problem is due partly to the considerable weight of the operating members. Attempts to reduce the weight of the operating members by eliminating structural material by constructing the sofa bed of lighter weight material have generally resulted in furniture of fragile construction or increased costs. In addition, the operating mechanisms joining the extensible sections are usually wheels or rollers which are subject to wear and can easily slip from their guiding track, thereby rendering the bed mechanism inoperable. Some patents to extensible sofa-beds are Bartolucci, U.S. Pat. No. 2,783,479; Gertler, U.S. Pat. No. 3,385,631; Shellow et al, U.S. Pat. No. 3,972,079; Komarov, U.S. Pat. No. 4,067,073; Dushane, U.S. Pat. No. 4,166,299; Lane et al, U.S. Pat. No. 4,204,287; and Rasnick, U.S. Pat. No. 4,803,742.

Some of the drawbacks of the conventional convertible sofa bed from a consumers standpoint are: it is heavy, it is difficult to open and close, and it is prone to injure fingers, elbows, heads, backs and toes. The springs are extremely soft and therefore uncomfortable. Also the springs provide no back support and the mattress is usually of poor quality. Quite often the unit is too short as a bed if it is only six feet long. Additional drawbacks are: the units leave large indentations in carpets, the units deteriorate rapidly and often need repair.

It is an object of the invention to provide a novel sofa-platform bed that is comfortable and one which provides good back support.

It is also an object of the invention to provide a novel sofa-platform bed that is lightweight.

It is also an object of the invention to provide a novel sofa-platform bed that is easy to open and close.

It is another object of the invention to provide a novel sofa-platform bed that can be made in any bed size: twin, single, double, queen or king, and in any length.

It is an additional object of the invention to provide a novel sofa-platform bed that would have a mattress that would be longer than six feet.

It also an object of the invention to provide a novel sofa-platform bed that provides a surface upon which the mattress rests that is dead level.

It is a further object of the invention to provide a novel sofa-platform bed that can be built in any sofa style from French Provincial to the most modern on its understructure.

SUMMARY OF THE INVENTION

The inventor's novel sofa-platform bed has a transversely extending stationary frame and it has a left arm assembly, a right arm assembly and a back assembly attached thereto. In its preferred form, the seat cushion would have a length of 6 feet 6 inches and it would be either 27 inches, 30 inches, or 39 inches wide (i.e., ½ the width of a double, queen or king sized bed respectively) which when in the sofa configuration lie either one on top of the other to form the seating surface or are hinged to form the seat and backpads of the sofa. When placed in the sleeping configuration, the two mattress are turned 90 degrees and placed side by side so that each of the two persons sleeping upon them have a one piece mattress 6 feet 6 inches long with no creases, cut or folds across the body.

A plurality of telescoping slide assemblies each have their rear end secured to the stationary frame. Each of the telescoping slide assemblies has an elongated rear telescoping member, at least one elongated intermediate telescoping member and an elongated front telescoping member. A cross member is secured to the front ends of the respective telescoping slide assemblies and a pair of front legs would be supported therebeneath. A central area front trim wall hides the cross member and front legs and also provides a gripping structure for easily pulling the telescoping slide assemblies to their extended position.

The top wall surfaces of each of the telescoping members is in substantially the same horizontal plane when they are in their retracted position and when they are in their extended position. The telescoping slide assemblies may be made in different forms, such as wood or metal telescoping members.

The area beneath the seat cushion which forms a support surface for the seat cushion has a recess within which is stored a cushion support platform assembly. This structure may take one of several different forms. One such example would be to have at least three elongated platform panels that are hinged together along their lateral surfaces in such a manner they can be stacked upon one another or expanded in an accordian fashion to provide a planar bottom surface that rests on the planar top surface of the telescoping slide assemblies in their extended state. Another version of a cushion support platform assembly utilizes a large number of elongated slats that are laterally spaced from each other and connected together by a pair of laterally spaced cord or ribbon members. The front slat would be attached to the front cross member that connects the respective telescoping slide assemblies so that when it is pulled to open the sofa into a bed the slats are pulled by the ribbon until they are an equal distance from each other (approximately 2 inches) like a venetian blind. Thereby a 33 inch seating depth becomes a 6 foot 6 inch bed. Another alternative version for a cushion support platform assembly would be to use a large number of transversely extending metal slats that have a plurality of laterally spaced transversely extending slots in them. Rivets connecting between adjacent slats would travel in the respective transversely extending slots to allow a relatively small width cushion support platform assembly to be extended into a 6 foot 6 inch bed.

The lateral spacing of the left side and right side telescoping slide assemblies is such that they would be spaced inwardly approximately 1 foot from the lateral edges of the cushion support platform assembly in its extended position. Since the front legs are also spaced inwardly a similar distance, a person does not have to worry about stubbing their toes on them while making the bed.

DESCRIPTION OF THE PREFERRED EMBODIMENT

The novel sofa-platform bed will now be described by referring to FIGS. 1–15 of the drawings. The sofa-platform bed is generally designated numeral 20.

Figure 1:
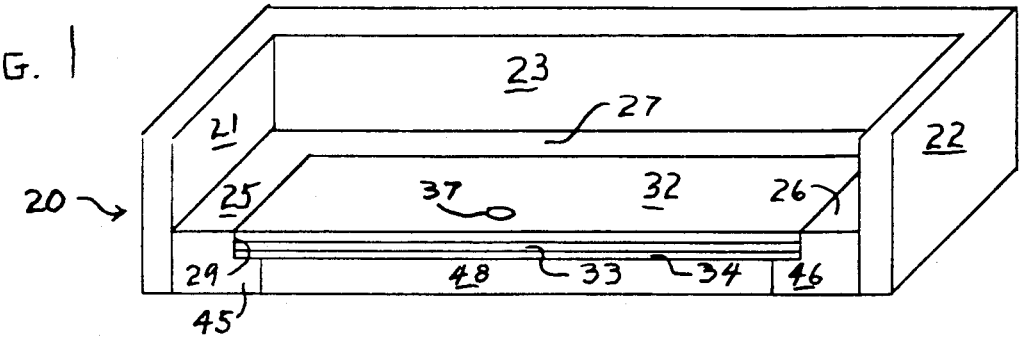
FIG. 1 is a front perspective view of the novel sofa-platform bed in its sofa state and with its cushions removed.
Figure 2:
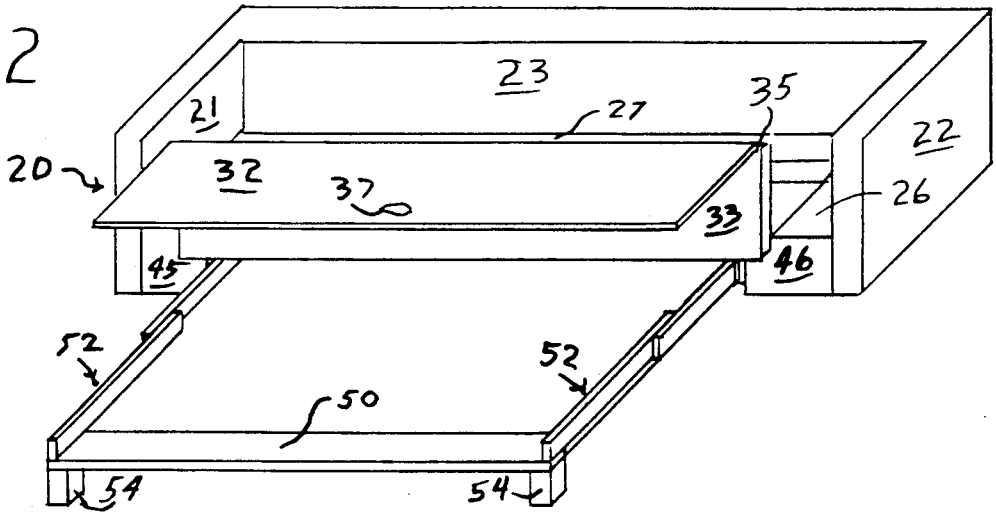
FIG. 2 illustrates the sofa-platform bed of FIG. 1 with its telescoping slide assemblies in their partially extended state.
Figure 3:
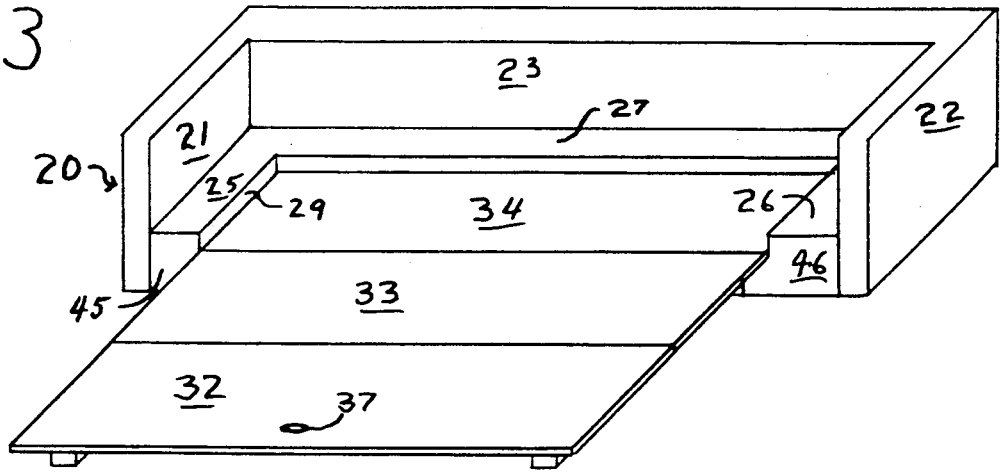
FIG. 3 is a front perspective view showing the cushion support platform assembly in its extended position.
Figure 4:
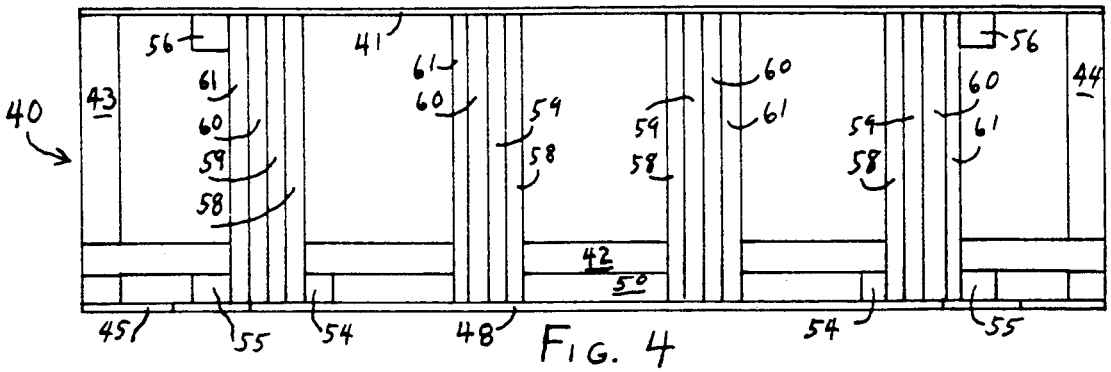
FIG. 4 is a top plan view of the stationary frame assembly of the sofa-platfrom bed.
Figure 5:
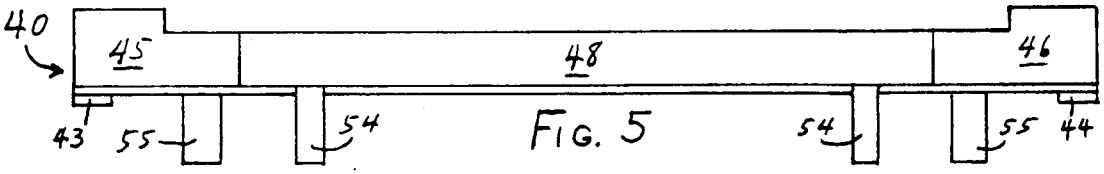
FIG. 5 is a front elevation view of the stationary frame assembly illustrated in FIG. 4.
Figure 6:
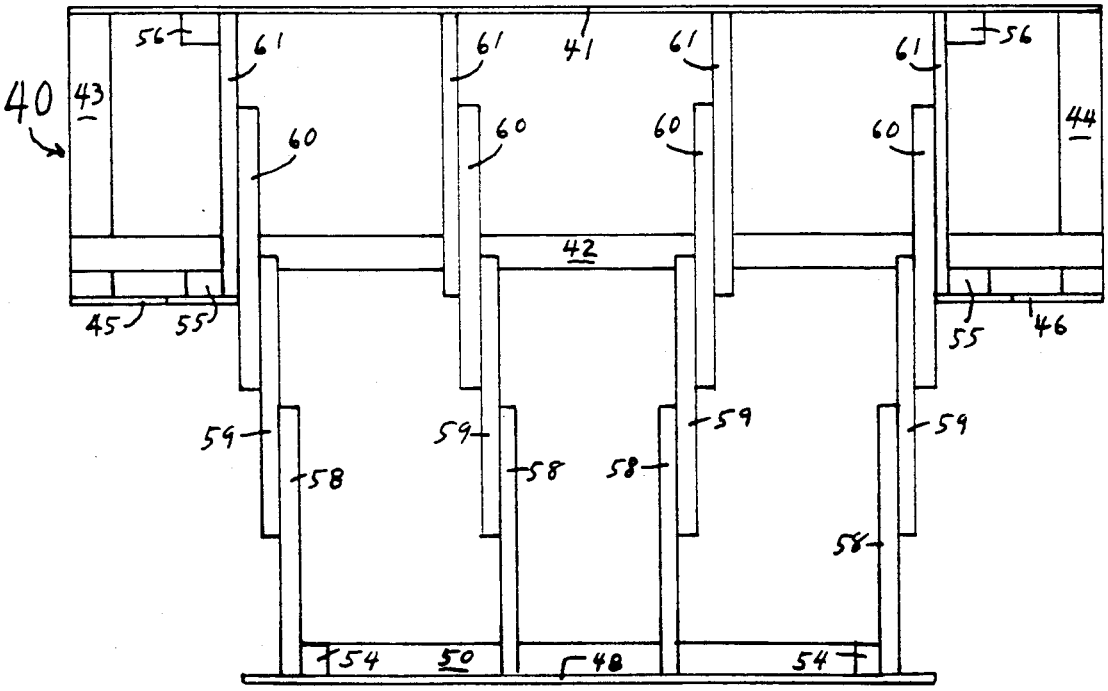
FIG. 6 is a top plan view of the stationary frame assembly showing the telescoping assemblies in their extended position.
Figure 8:
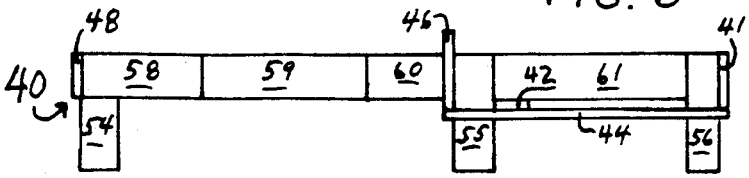
FIG. 8 is a side elevation of the stationary frame assembly and the telescoping slide assemblies in their extended state.
Figure 7:
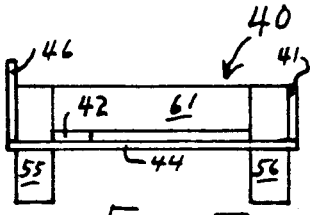
FIG. 7 is a side elevational view of the stationary frame assembly in its retracted state.
Figure 9A:
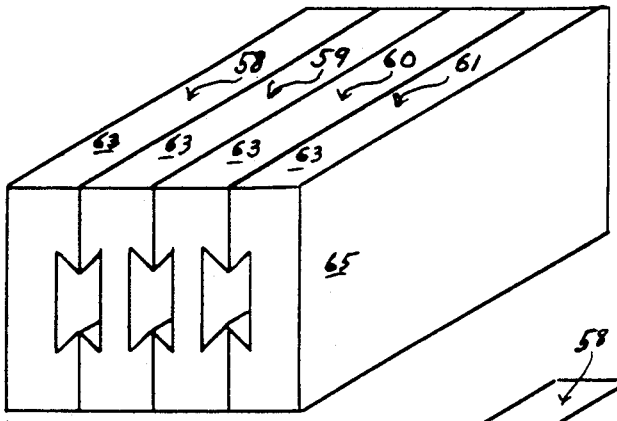
FIG. 9A is a front perspective view of one of the telescoping slide assemblies in its retracted state.
Figure 9B:
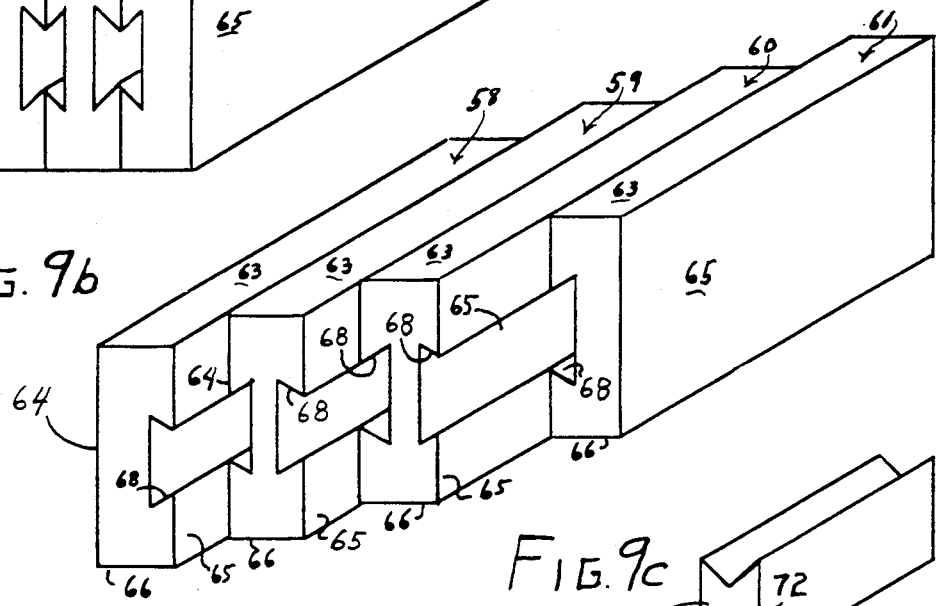
FIG. 9B is a front perspective view of one of the telescoping slide assemblies in its partially extended state.
Figure 9C:
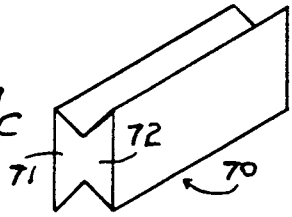
FIG. 9C is a front perspective view of one of the dovetail members utilized in the telescoping slide assemblies.

In FIGS. 1–3, the sofa-platform bed 20 is shown in its retracted and expanded state. It has a stationary frame assembly (not shown in these Figures) and mounted above this is a left arm assembly 21 a right arm assembly 22 and a couch back assembly 23. A support surface for the cushion/mattress structure is formed by left end top support wall 25, right end support top support wall 26, and rear top support wall 27. A recess 29 is formed in this support surface for receiving the cushion support platform assembly 30.

Cushion support platform assembly 30 is formed from front platform panel 32, intermediate platform panel 33, and rear platform panel 34 that are connected together by hinges 35. A fingergrip aperture 37 is formed in front platform panel 32 so that the cushion support platform assembly can be pulled to its extended position.

The stationary frame assembly 40 is best understood by referring to FIGS. 2 and 4–8. It is formed from rear cross member 41, front cross member 42 and laterally spaced connecting members 43 and 44. Secured to the front end of stationary frame assembly 40 and its connecting members 43 and 44 are left end front trim wall 45 and right end front trim wall 46. A central area front trim wall 48 is connected to the front end of the cross member 50 and the telescoping slide assemblies 52. Front leg members 54 are also secured to cross member 50. Rear leg members 56 are secured to rear cross member 41 of the stationary frame assembly. Intermediate legs 55 are secured to the bottom of front cross member 42.

Telescoping slide assemblies 52 are formed from front telescoping member 58, intermediate telescoping members 59 and 60, and rear telescoping members 61. The specific structure of these telescoping members is best understood by referring to FIGS. 9A, 9B, and 9C. Each of the telescoping members have a top wall surface 63, a left side wall surface 64, a right side wall surface 65 and a bottom wall surface 66. Dove-tail slots 68 are formed in the adjacent side wall surfaces of the respective telescoping members. Matingly interconnecting the telescoping members are dovetail members 70 that each have a left side wedge portion 71 and a right side wedge portion 72.

Figure 10:
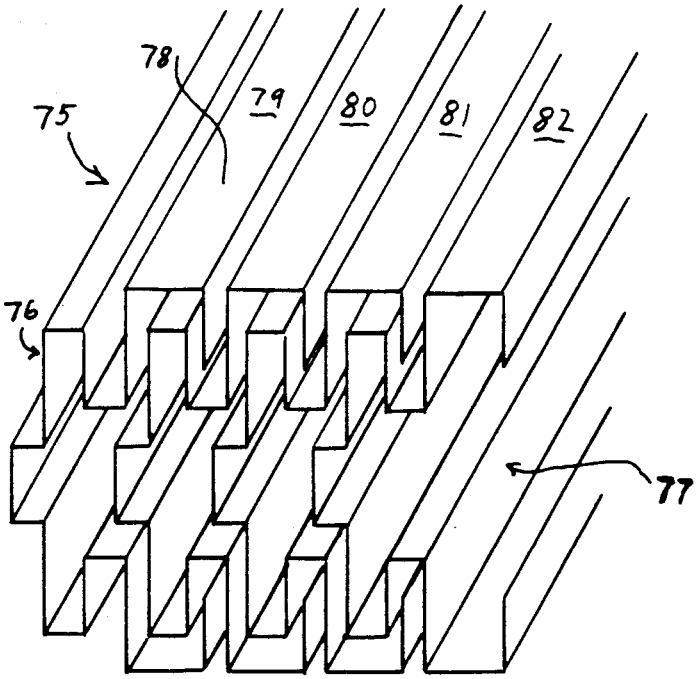
FIG. 10 is a schematic partial front perspective view of a first alternative embodiment for the telescoping slide assemblies.
Figure 11C:
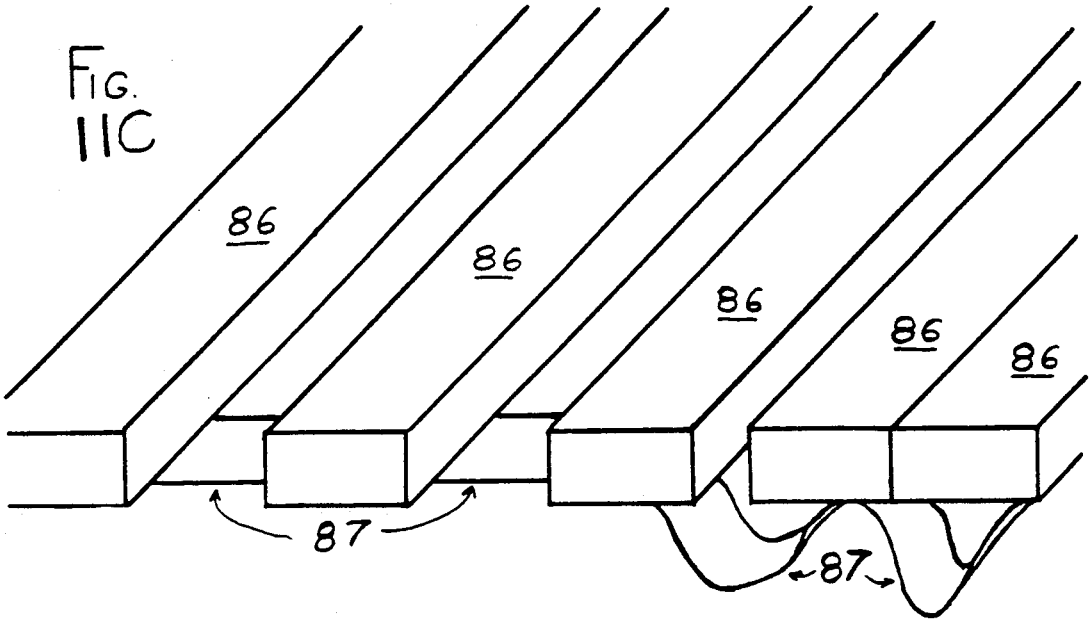
FIG. 11C is a partial side perspective view illustrating the alternative cushion support platform assembly in its partially extended state.

A first alternative form of telescoping slide assembly is illustrated in FIG. 10 and designated numeral 75. It uses a plurality of interlocking elongated sheet metal strips each having a left side wall surface 76, a right side wall surface 77 and a top wall surface 78. Telescoping slide assembly 75 would have a front telescoping member 79, intermediate telescoping members 80 and 81 and a rear telescoping member 82. All of the top wall surfaces would be coplanar and the telescoping slide assembly would function essentially the same as telescoping slide assembly 52.

A first alternative cushion support assembly is illustrated in FIGS. in 11A, 11B and 11C. A plurality of elongated slats 86 have a ribbon 87 stapled to their bottom surface with a predetermined spacing between each of them. In a preferred form, the slats are 1½ inches wide and include a sufficient number so that when pulled from their retracted state in FIG. 11A to their extended state in FIG. 11B, the cushion support assembly becomes a 6 foot 6 inch bed.

Figure 12A:
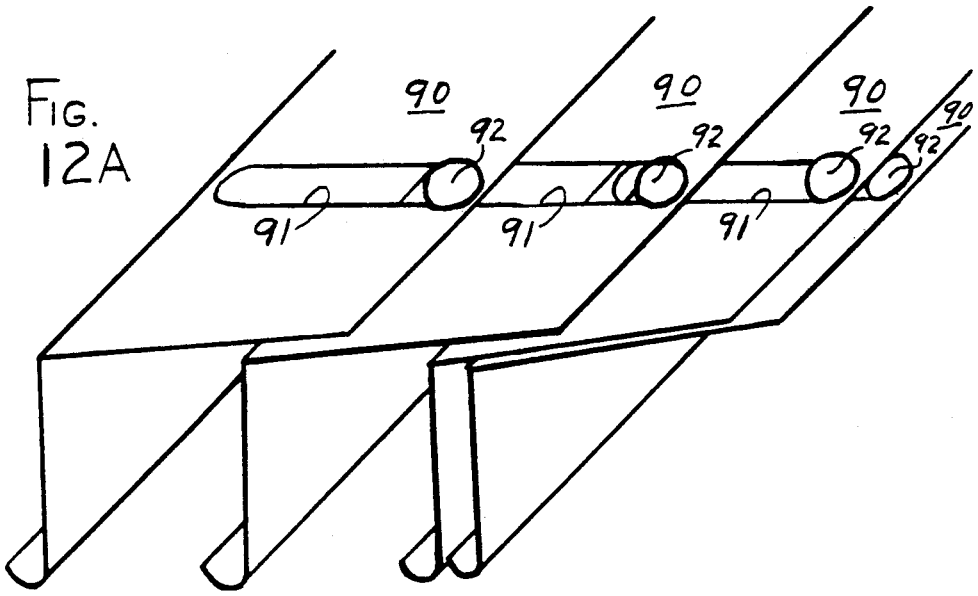
FIG. 12A is a partial side elevation view of a second alternative cushion support platform assembly.
Figure 12B:
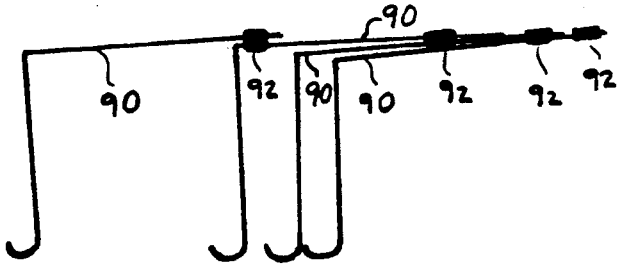
FIG. 12B is a schematic side elevation view of the second alternative cushion support platform assembly.
Figure 11A:
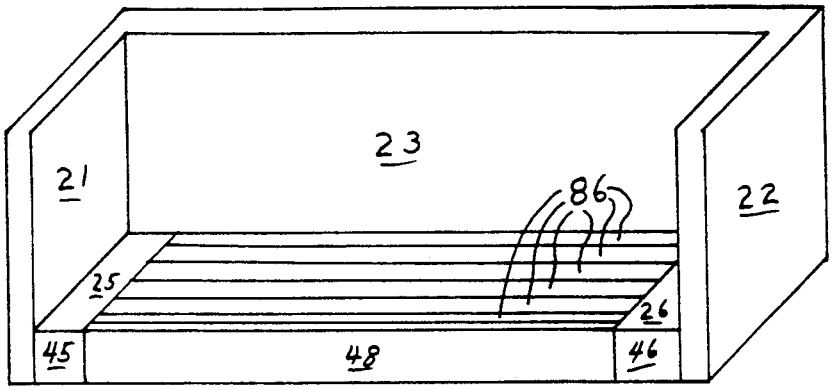
FIG. 11A is a front perspective view of the novel sofa-platform bed with a first alternative cushion support platform assembly shown in its retracted state.
Figure 11B:
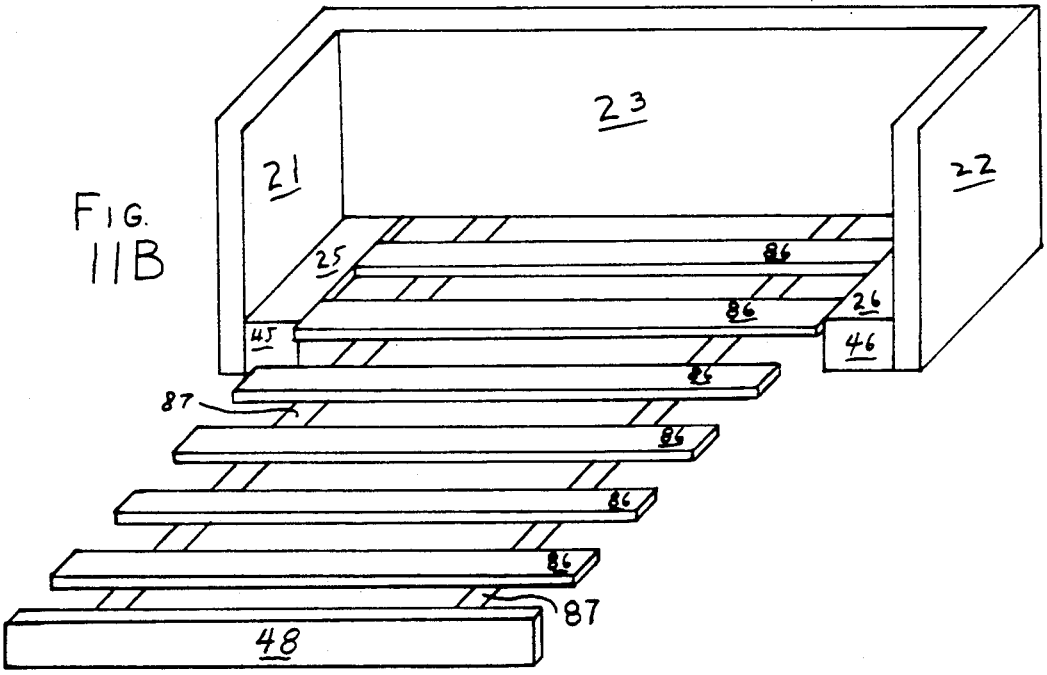
FIG. 11B is a front perspective view showing the alternative cushion support platform assembly illustrated in FIG. 11A now shown in its extended state.

A second alternative cushion support assembly 89 is illustrated in FIGS. 12A and 12B. It has a plurality of angle shaped metal slats 90 each having transversely extending slots 91 at laterally spaced positions. Rivets 92 or other forms of fasteners would secure the respective metal slats 90 together and allow them to be retracted or extended in the manner illustrated in these two Figures.

Figure 13:
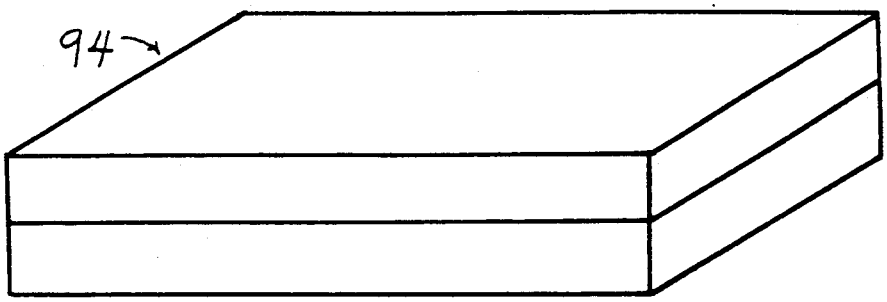
FIG. 13 is a front perspective view showing the mattress doubled over as a cushion for the sofa.
Figure 14:
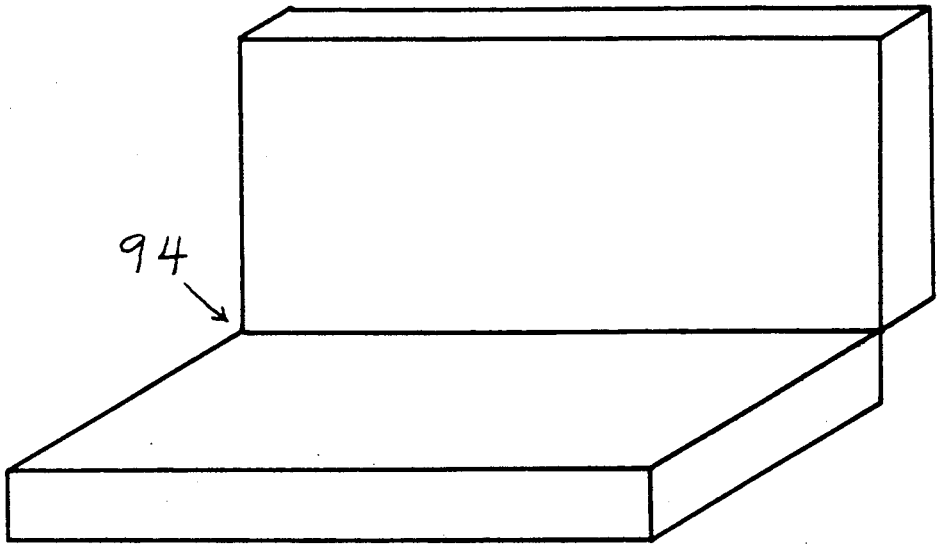
FIG. 14 is a front perspective view showing the mattress opened to a 90 degree angle to serve as a seat cushion and back cushion for the sofa.
Figure 15:
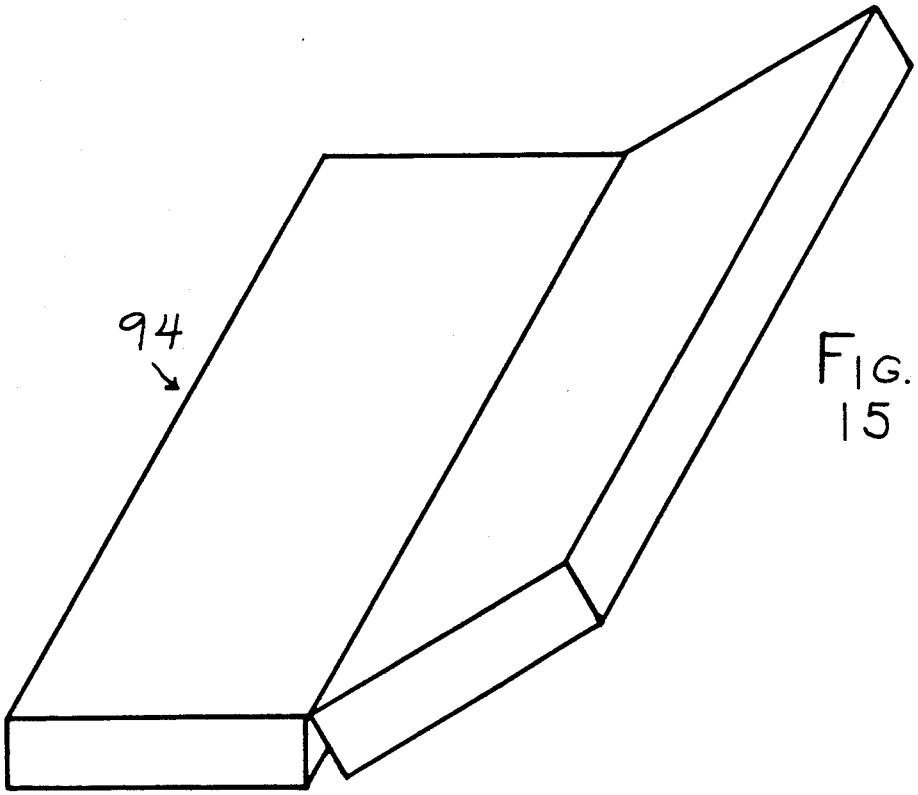
FIG. 15 is front perspective illustrating the sofa cushions opened to form a mattress and turned 90 degrees to the position they would occupy on the cushion support platform assembly.

The mattress 94 is illustrated in FIGS. 13–15. In FIG. 13 it is doubled over when it is used as a cushion for the sofa seat. In FIG. 14 the two sections of the mattress 94 are oriented at a ninety degree angle to each other to serve as a cushion seat and cushion back for the sofa. In its preferred form there would be two separate mattresses that would be hinged together by its cloth covering. The length of the mattress would be 6 foot 6 inches and the width would vary depending upon whether it was a double bed, queen size or king size bed. In FIG. 15 the mattress has been rotated ninety degrees to orient it in the manner in which it would be placed upon the cushion support platform assemblies.

What is claimed is:

1. A sofa-platform bed comprising:

a transversely extending stationary frame having a top surface;

a left arm assembly, a right arm assembly and a back assembly attached to said stationary frame;

at least two telescoping slide assemblies each having a front end and a rear end, said telescoping slide assemblies being laterally spaced from each other and being oriented substantially perpendicular to the width of said stationary frame; and each of said telescoping slide assemblies having an elongated rear telescoping member, at least one elongated intermediate telescoping member, and an elongated front telescoping member; said rear telescoping members being rigidly secured to said stationary frame; said telescoping members all having a top wall surface (that remains in substantially the same horizontal plane when they are in their retracted positon and in their extended position) in the same horizontal plane and said top wall surfaces remain in the same horizontal plane throughout the full course of their travel from their retracted position to their extended position.

2. A sofa-platform bed as recited in claim 1 further comprising at least two rear leg members each having a top end that is secured to said stationary frame to space it a predetermined height above the floor.

3. A sofa-platform bed as recited in claim 2 further comprising at least two front leg members each having a top end and means for securing the top end of said front leg members to the elongated front members of said telescoping slide assemblies.

4. A sofa-platform bed as recited in claim 1 further comprising a cross member rigidly securing the front end of said telescoping slide members together.

5. A sofa-platform bed as recited in claim 1 further comprising a cushion support assembly that is secured to the top surface of said stationary frame.

6. A sofa-platform bed as recited in claim 5 wherein said cushion support assembly is formed of a plurality of platform panels that are hinged together in such a manner that they can be stacked one upon another or expanded in an accordian fashion to provide a planar bottom surface that rests on the planar top surface of said telescoping slide assemblies in their extended state.

7. A sofa-platform bed comprising:

a transversely extending stationary frame having a top surface;

a left arm assembly, a right arm assembly and a back assembly attached to said stationary frame;

at least two telescoping slide assemblies each having a front end and a rear end, said telescoping slide assemblies being laterally spaced from each other and being oriented substantially perpendicular to the width of said stationary frame;

each of said telescoping slide assemblies having an elongated rear telescoping member, at least one elongated intermediate telescoping member, and an elongated front telescoping member; said rear telescoping members being rigidly secured to said stationary frame; said telescoping members all having a top wall surface that remains in substantially the same horizontal plane when they are in their retracted position and in their extended position; and a cushion support assembly that is secured to the top surface of said stationary frame, said cushion support assembly is formed of a plurality of elongated slat members having at least two laterally spaced flexible ribbon members secured to them at predetermined spacings along the length of said ribbons to provide a cushion support assembly whose length can be expanded from a stored state to an expanded full length bed state.

8. A sofa-platform bed comprising:

a transversely extending stationary frame having a top surface;

a left arm assembly, a right assembly and a back assembly attached to said stationary frame;

at least two telescoping slide assemblies each having a front end and a rear end, said telescoping slide assemblies being laterally spaced from each other and being oriented substantially perpendicular to the width of said stationary frame;

each of said telescoping slide assemblies having an elongated rear telescoping member, at least one elongated intermediate telescoping member, and an elongated front telescoping member; said rear telescoping members being rigidly secured to said stationary frame; said telescoping members all having a top wall surface that remains in substantially the same horizontal plane when they are in their retracted position and in their extended position; and a cushion support assembly that is secured to the top surface of said stationary frame, said cushion support assembly is formed of elongated slat members each having laterally spaced transversely extending slats and fastening means for securing the adjacent slot members together so they can be telescopically extended apart to form a full length bed matress support surface and also telescope together in a nested stacked stored position.

9. A sofa-platform bed comprising:

a transversely extending stationary frame having a top surface;

a left arm assembly, a right arm assembly and a back assembly attached to said stationary frame;

at least two telescoping slide assemblies each having a front end and a rear end, said telescoping slide assemblies being laterally spaced from each other and being oriented substantially perpendicular to the width of said stationary frame;

each of said telescoping slide assemblies having an elongated rear telescoping member, at least one elongated intermediate telescoping member, and an elongated front telescoping member; said rear telescoping members being rigidly secured to said stationary frame; said telescoping members all having a top wall surface that remains in substantially the same horizontal plane when they are in their retracted position and in their extended position; and said telescoping slide assemblies are formed of elongated telescoping members made of wood members each having a top wall surface, a left side wall surface and a right side wall surface; the respective side wall surfaces of the adjacent elongated members have dovetail slots formed therein that receive the respective left side wedge portion and right side wedge portion of elongated dovetail members that connect the adjacent elongated telescoping members together.

10. A sofa-platform bed comprising:

a transversely extending stationary frame having a top surface;

a left arm assembly, a right arm assembly and a back assembly attached to said stationary frame;

at least two telescoping slide assemblies each having a front end and a rear end, said telescoping slide assemblies being laterally spaced from each other and being oriented substantially perpendicular to the width of said stationary frame;

each of said telescoping slide assemblies having an elongated rear telescoping member, at least one elongated intermediate telescoping member, and an elongated front telescoping member; said rear telescoping members being rigidly secured to said stationary frame; said telescoping members all having a top wall surface that remains in substantially the same horizontal plane when they are in their retracted positon and in their extended position; and said telescoping slide assemblies are formed of elongated telescoping members made of metal and each has a top wall surface, a left side wall surface and a right side wall surface, the respective right side wall surfaces are configured in a predetermined groove shape and the respective left side wall surfaces are configured in a predetermined tongue configuration that is matingly received in said adjacent groove.

* * * * *